US006061541A

United States Patent [19]

Bessette

[11] Patent Number: 6,061,541

[45] Date of Patent: May 9, 2000

[54] SUPPLEMENTAL MAGNET STRIP FOR TONER CARTRIDGE DEVELOPER ROLL MAGNET AND METHOD FOR EMPLOYING THE SAME

[75] Inventor: Lionel Bessette, Worcester, Mass.

[73] Assignee: Clarity Imaging Technologies, Inc., Springfield, Mass.

[21] Appl. No.: 09/097,343

[22] Filed: Jun. 15, 1998

Related U.S. Application Data

[63] Continuation-in-part of application No. 08/697,975, Sep. 4, 1996, Pat. No. 5,768,667.

[51] Int. Cl.[7] ..... G03G 15/09

[52] U.S. Cl. ..... 399/277

[58] Field of Search ..... 399/267, 276, 399/277

[56] References Cited

U.S. PATENT DOCUMENTS

| | | | |
|---|---|---|---|
| 4,354,454 | 10/1982 | Nishikawa | 399/277 |
| 4,638,281 | 1/1987 | Baermann | 335/303 |
| 5,063,399 | 11/1991 | Zeman et al. | 346/160.1 |
| 5,359,397 | 10/1994 | Yamaji | 399/277 |
| 5,529,628 | 6/1996 | Fuchiwaki et al. | 399/276 X |
| 5,634,183 | 5/1997 | Saito et al. | 399/277 |
| 5,668,519 | 9/1997 | Yamashita | 399/257 X |
| 5,768,667 | 6/1998 | Bessette | 399/275 |
| 5,860,049 | 1/1999 | Kumasaka et al. | 399/277 X |

FOREIGN PATENT DOCUMENTS

| | | |
|---|---|---|
| 0764890 | 3/1997 | European Pat. Off. . |
| 0773484 | 5/1997 | European Pat. Off. . |
| 57-188048 | 11/1982 | Japan . |

OTHER PUBLICATIONS

Patent Abstracts of Japan; vol. 007, No. 035 (P–175), Feb. 10, 1983 & JP 57 188048 A (Copyer KK; Others: 01), Nov. 18, 1982 abstract.

International Search Report.

*Primary Examiner*—William J. Royer

*Attorney, Agent, or Firm*—William A. Loginov; Cesari and McKenna, LLP

[57] ABSTRACT

An improved developer roll magnet for a toner cartridge provides a strip of magnetic material that extends axially along a surface of the developer roll magnet located coaxially within a developer roll sleeve. The strip of magnetic material can be seated within a groove in the magnet and can extend radially outwardly above the surface of the magnet. The strip is generally adhered to the magnet by mutual magnetic attraction and can be made adjustable to move toward and away from the developer roll sleeve. The strip is typically located adjacent a nip formed between the developer roll sleeve and the image transfer drum of the cartridge to provide enhanced toner release for greater print yield and quality.

20 Claims, 6 Drawing Sheets

SUPPLEMENTAL MAGNET STRIP FOR TONER CARTRIDGE DEVELOPER ROLL MAGNET AND METHOD FOR EMPLOYING THE SAME

RELATED APPLICATIONS

This is a continuation-in-part of U.S. patent application Ser. No. 08/697,975, filed Sep. 4, 1996 now U.S. Pat. No. 5,768,667.

FIELD OF THE INVENTION

This invention relates to an improved developer roll magnet for a toner cartridge and more particularly to the application of a variable strength magnetic surface to an otherwise-uniform cylindrical magnet.

BACKGROUND OF THE INVENTION

Toner cartridges for use in copiers, printers and other image transfer devices have become the predominant source of replaceable printing toner. The cartridge typically incorporates an electrostatically or magnetically attracted toner that is usually a "one-part" system in which the colorant, fusible substrate and attractive media are all incorporated in a single particle. The developer roll is a rotating sleeve that surrounds a stationary magnet mounted concentrically within the rotating sleeve. The magnet includes North and South poles that extend axially along the magnet surface. The poles cause the toner in the tank to be magnetically attracted to the developer roll and enable its subsequent release at the "nip" between the developer roll and the image transfer drum.

U.S. Pat. No. 5,315,325 describes a technique for aligning the poles of the cylindrical magnet for optimum toner release from the developer roll to the image transfer drum. This patent is expressly incorporated herein by reference. It teaches the provision of a rotatable cylindrical magnet that is rotated to optimally align the magnet so that release of toner onto the image drum is optimized. The underlying magnet is, otherwise, unchanged and is of conventional design.

The above-described technique for adjusting a developer magnet is limited in that different magnets may have differing magnetic field properties and strengths. As a result, the print yield and print quality in different cartridges is still variable due to inherent differences between magnets. In other words, if a magnet has poor characteristics, optimization will still yield a substandard cartridge.

It is, therefore, an object of this invention to provide an improved magnet for the developer roll of a toner cartridge that reduces the inherent variability between magnets. The improved magnet should concentrate field strength where it is most needed at the nip between the developer roll and the image transfer drum. The improved magnet should be easy to produce and compatible with existing toner cartridge components. The magnet should allow the field strength to be customized for optimum performance.

SUMMARY OF THE INVENTION

An improved magnet for the developer roll of a toner cartridge is provided according to this invention. The disadvantages of the prior art are overcome by concentrating an additional section of magnetic material on the surface of the developer roll magnet in a location that enables improved release of toner from the developer roll sleeve to the image transfer drum.

According to a preferred embodiment, a developer roll for a toner cartridge includes a developer roll sleeve rotatably mounted within a housing of the cartridge adjacent a toner tank and an image transfer drum. A substantially stationary developer roll magnet is located within the developer roll sleeve. The magnet is substantially cylindrical and is substantially coaxial with the developer roll sleeve. A strip of magnetic material extends axially along a surface of the magnet at a predetermined position about a circumference of the magnet. The strip defines an increased magnetic field at the predetermined position along the developer roll magnet's surface. A groove can be located along the predetermined location for seating the strip. The strip can comprise a flexible magnet having a rectangular cross-section. The magnet is typically thin, having a thickness of approximately 1/16 inch and a width of approximately 1/8 inch. The strip is typically located adjacent a nip formed between the developer roll sleeve and the image transfer drum. This nip location corresponds substantially to the location of one of the North poles of the magnet. The strip can be attached to the magnet using adhesives, fasteners, or by mutual magnet attraction between the strip and the underlying developer roll magnet.

According to an alternate embodiment, the strip can be mounted on a base member that is movable toward and away from the developer roll sleeve. An elongated groove can be provided on the surface of the magnet for receiving the base member. The groove and the base member can each include interengaging formations such as ramps and pins that enable the base member to move radially in response to an axial movement of the base member by an adjusting member.

According to another embodiment, a method for improving a developer magnet that is coaxially mounted within a developer roll sleeve of a toner cartridge includes the step of defining a groove in the magnet. The groove extends axially across a predetermined length of the surface of the magnet. A strip of magnetic material is located within the groove. The strip provides an enhanced magnetic field in a predetermined location. The magnet can be variably rotationally oriented so that the strip magnetic material is adjacent a nip formed between the developer roll sleeve and an image transfer drum The rotational/circumferential orientation can be particularly chosen to optimize the developer roll's magnetic characteristics adjacent to the nip. The radial location of the strip of magnetic material can be varied to selectively position the strip at a predetermined distance relative to the developer roll sleeve to change a strength and field characteristics at the nip. A movable base member can be provided within the groove. This base member can be moved radially toward and away from the developer roll sleeve to, thereby, move the strip.

In another embodiment, the magnetic strip can be located on the developer roll magnet in a groove that has a circumferential offset near its ends. This reduces the effects of the strip near the ends of the magnet.

In yet another embodiment, the magnetic strip can be tapered to a reduced radial depth or thickness near its opposing ends. A linear or circumferentially variable groove can be used to seat the tapered magnet. This arrangement also reduces the effects of the magnetic strip near the ends. The magnetic strip can float freely or be cemented into the groove. The taper can be continuous in the form of a straight or curved ramp, or can be a series of steps of varying thickness.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
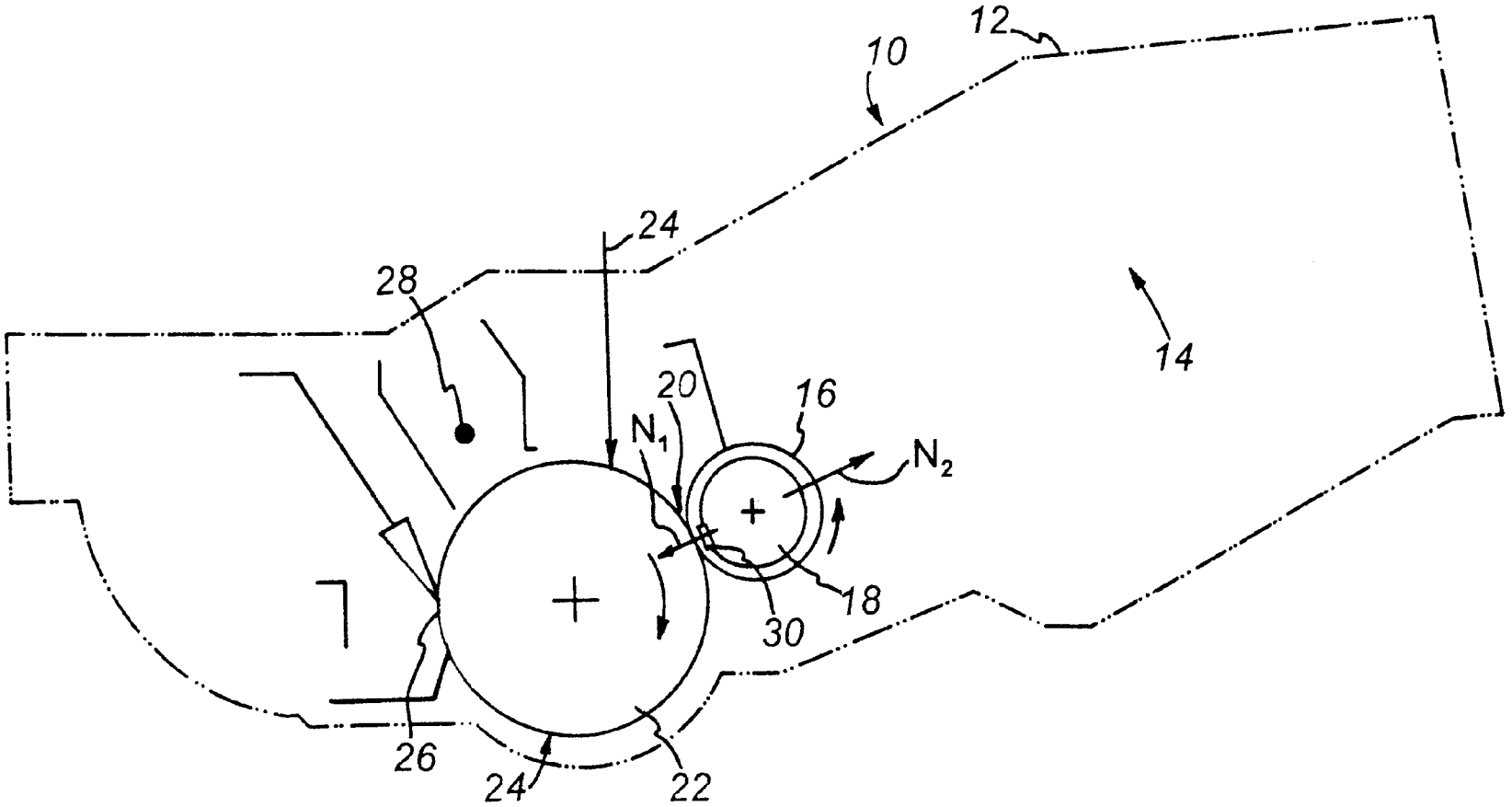
FIG. 1 is a schematic cross-section of a printer toner cartridge having an improved developer roll magnet according to this invention.

FIG. 1 illustrates a conventional toner cartridge having an improved developer roll magnet according to this invention. The cartridge 10 is a Canon SX-type cartridge for use in laser printers and other image transfer devices. The principals described herein are, however, applicable to a variety of cartridge types usable in a variety of image transfer devices including laser printers, copiers and facsimile machines.

The cartridge 10 includes a housing 12 having a toner tank 14 for storing a one-part toner. The cartridge is provided with a filled toner tank 14 by the manufacturer. When the toner in the tank is exhausted, the cartridge is typically discarded for remanufacture, at which time the toner tank is refilled and the various components are checked and replaced as needed.

Toner is extracted from the tank by the developer roll 16. The developer roll is a metallic sleeve that is permeable to magnetic fields provided by a central developer roll magnet 18. The magnet 18 comprises a long cylinder composed of a conventional magnetic material and having a first North Pole $N_1$ adjacent the nip 20 formed between the developer roll 16 and a rotating image drum 22 and a second North Pole $N_2$ adjacent the toner tank 14. As described above, the image drum 22 includes a photosensitive surface that becomes selectively charged in response to an applied light 24 that defines a predetermined pattern on the drum. The charge pattern on the surface of the drum causes toner from the developer roll 16 to be released at the nip 20 to the portions of the drum that have been charged. Toner is subsequently released from the charged areas of the drum to a printing surface (a sheet, transparency or continuous web) at the drum's release point 25. The remaining toner is scraped away by a blade 26 and a corona wire 28 removes any residual charge from the surface of the image drum 22 so that new patterns can be applied by the light 24.

Figure 2:
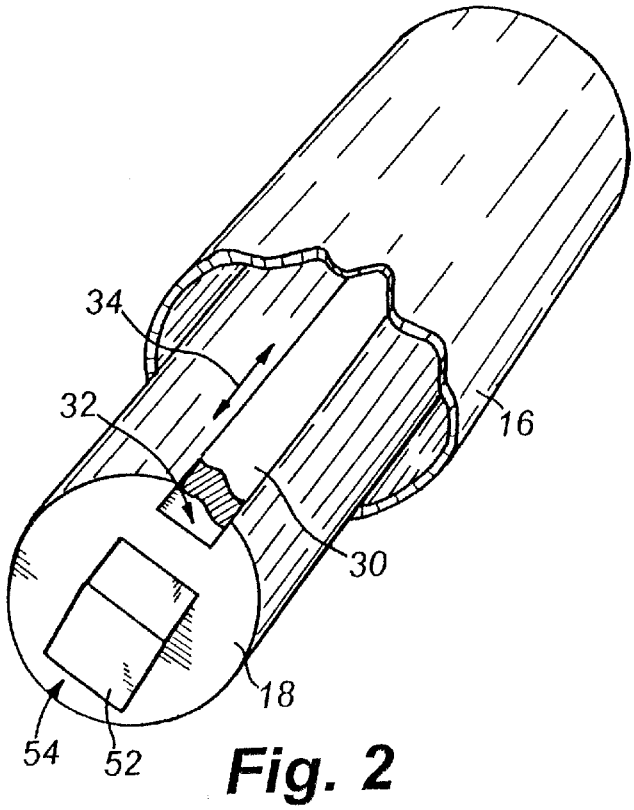
FIG. 2 is an exposed perspective view of an improved magnet and developer roll assembly according to his invention.
Figure 3:
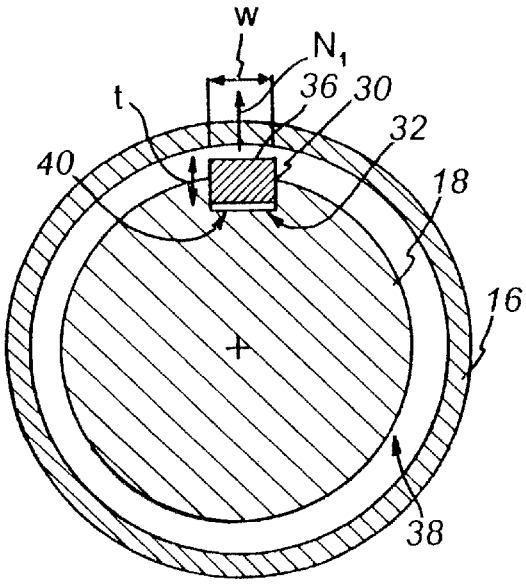
FIG. 3 is a side cross-section of the magnet and developer roll of FIG. 2.
Figure 4:
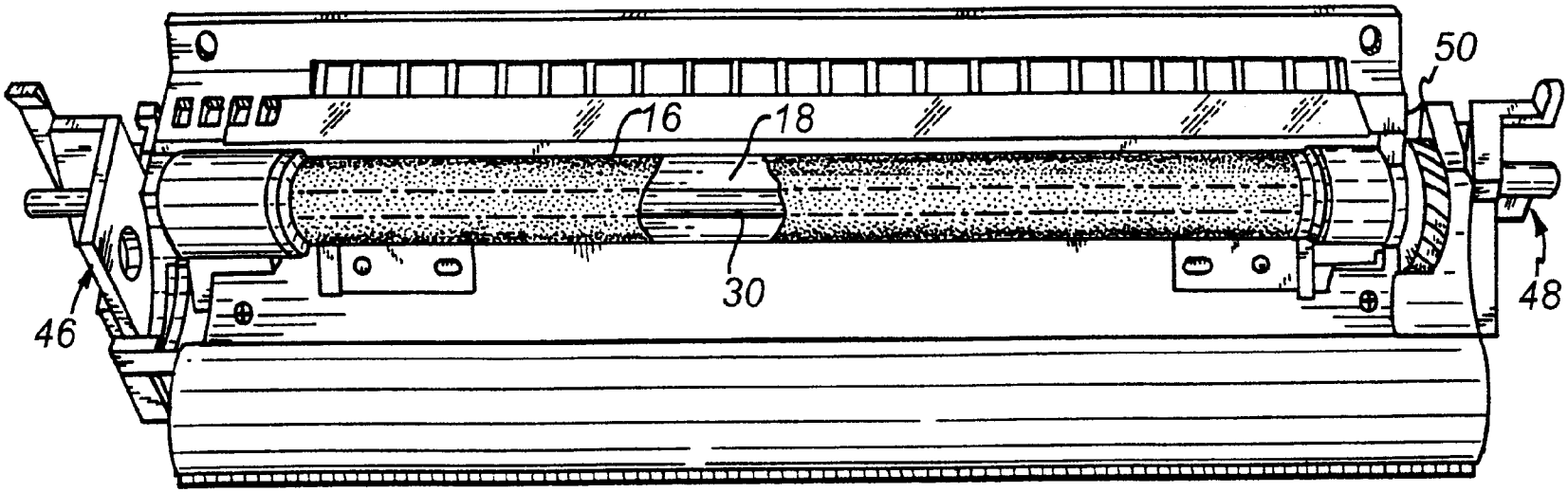
FIG. 4 is an exposed perspective view of the improved magnet and developer roll installed in a toner cartridge frame.

Unlike the prior art, the magnet 18 does not define a continuous surface, but rather, includes a magnetic strip 30 that extends axially along the magnet adjacent the nip 20. FIGS. 2, 3 and 4 further define the placement of the magnetic strip 30. The surface of the magnet 18, which typically comprises a synthetic matrix having magnetic particles disposed therein, is milled to include a groove 32 that extends axially (double arrow 34) along the length of the magnet 18. The groove 32 is sized with the width of between approximately ⅛ and 3⁄16 inch according to this embodiment. It has a depth of approximately 1⁄16 inch. These sizes are chosen to accommodate a magnetic strip 30 having commercially available dimensions. The magnetic strip 30 according to this embodiment is a flexible Reance 65 neodymium-iron-boron magnet. According to a preferred embodiment, it has a width w of approximately ⅛ inch and a thickness t of approximately 1⁄16 inch. The size of the groove 32 is chosen so that the strip 30 seats within the groove with minimal side-to-side movement. As detailed in FIG. 3, the strip typically projects upwardly from the surface so that it is brought into near contact with the inside surface of the developer roll 16. Hence the gap 36 between the inside surface and the strip is generally less than the gap 38 between the remaining magnet and the developer roll 16. The magnetic strip 30 is generally retained in engagement with the magnet 18 by mutual magnetic attraction. It is contemplated that various adhesives and mechanical joining techniques can be used to retain the magnetic strip 30 within the groove. Likewise the magnetic strip can be adhered directly to the unmilled surface of the magnet 18 in some embodiments. Where mutual magnetic attraction is used as a retaining force, the confronting fields of the magnetic strip 30 and the developer roll magnet 18 can cause the magnetic strip 30 to float within its groove. In other words, the magnet is spaced from the base 40 of the groove 32. This floating action can serve to bring the magnet into positive contact with the inner surface of the developer roll 16.

By providing an additional magnetic strip adjacent the pole $N_1$ an enhanced, more-focused magnetic field is presented at the nip 20 between the developer roll 16 and the image drum 22. A focused magnetic field of between 0.8 KGauss to approximately 2 KGauss is provided. The use of the magnetic strip of this invention adjacent the nip increases the toner yield (e.g., efficiency of toner usage) and delivers a more-constant density for print throughout the life of the cartridge. Particles are less likely to become dispersed since toner particles tend to release more-directly to intended areas of the image drum. In addition, the magnet strip of this invention allows a greater range of components to be used. Where such components would normally produce a low yield or poor quality print, the quality and yield have been improved to acceptable levels by the use of the magnetic strip 30 of this invention.

It is contemplated that the size and strength of the magnetic strip can be varied to provide specific toner release characteristics at the nip. For example, by changing the depth of the groove 32, the strip can be brought closer to or further away from the developer roll 16, thus changing the strength and focus of the magnetic field at the nip. In addition, wider or narrower strips can be used, also altering the field characteristics. While a preferred embodiment is described herein, it is contemplated that different cartridges can perform best using a different size and configuration of magnetic strip applied to the developer roll magnet. A suitable size and location for the magnetic strip can be determined for a given cartridge by trial and error, starting with a standard size and strength strip and incrementally increasing and decreasing the size and/or strength of the strip until print quality and efficiency is satisfactory.

The developer roll magnet 18 is typically mounted in end caps 46 and 48 (FIG. 4) that prevent the magnet from rotating. The developer roll 16 rotates in response to movement of the gear 50. A raised block 52 at the end 54 of the magnet 18 (see FIG. 2) fixes the magnet within the end cap 46. However, according to the above-described U.S. Pat. No. 5,315,325, the improved magnet of this invention can be mounted in end caps that allow rotational adjustment. Thus, the magnetic strip 30 and North Pole $N_1$ can be positioned at a desired location relative to the nip. Conversely, the groove 32 can be milled so that it is located at an exact location regardless of underlying misalignments in the poles of the magnet. In this manner, the strip 30 can be positioned so that it corrects some of the problems associated with pole misalignment.

Figure 5:
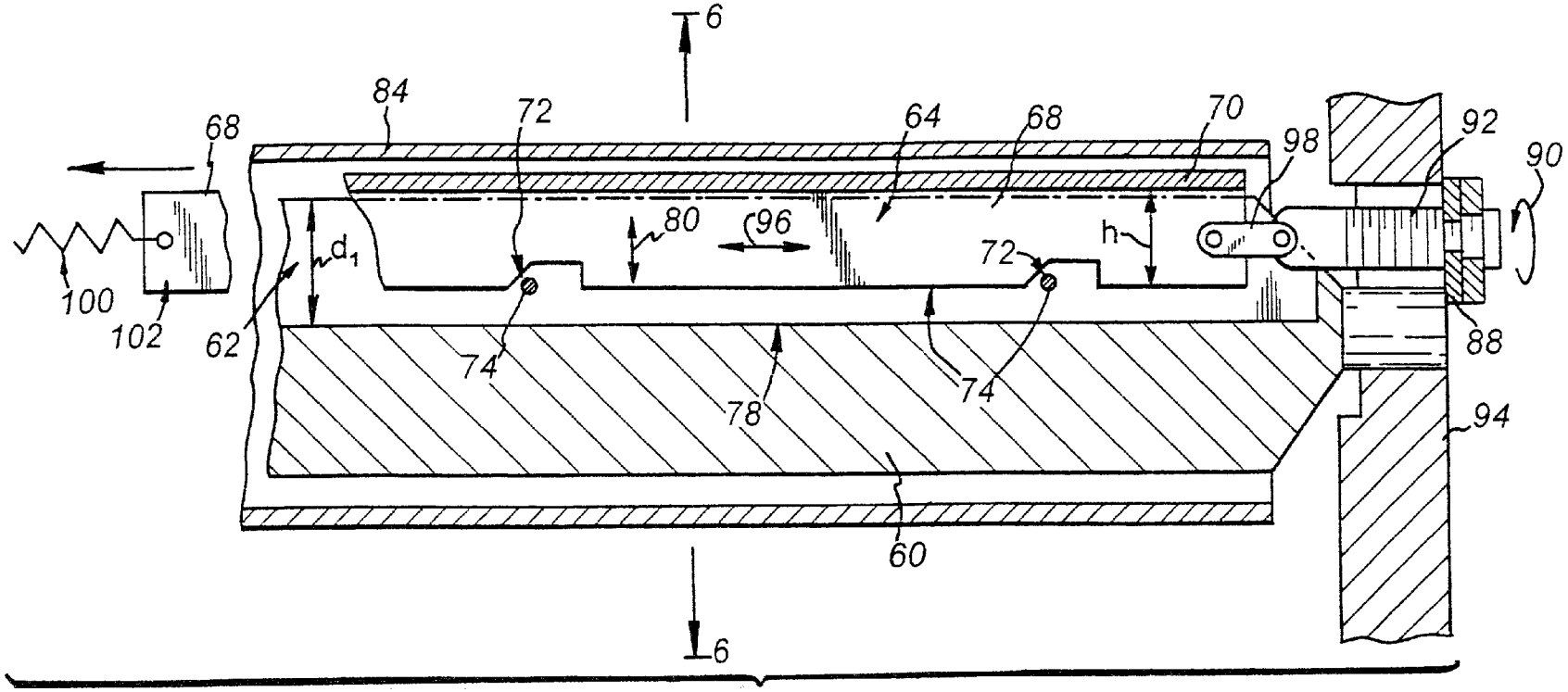
FIG. 5 is a partial side cross-section of a developer roll and magnet assembly having an adjustable magnetic strip according to an alternate embodiment of this invention.
Figure 6:
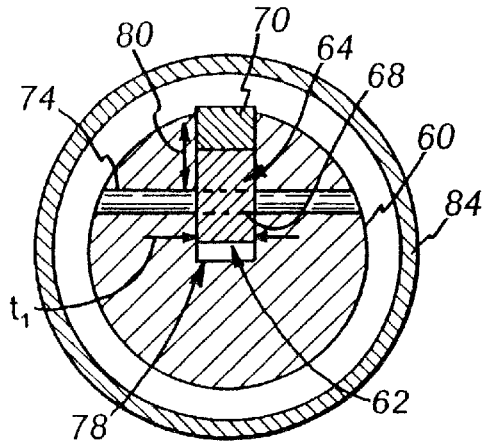
FIG. 6 is a side cross-section of the developer roll and magnet assembly taken along line 6—6 of FIG. 5.

As noted above, magnetic field strength and focus can be varied by moving the magnet strip closer to the inner surface of the developer roll. FIGS. 5 and 6 detail a mechanism that enables variable adjustment of the spacing of the strip from the developer roll. According to the alternate embodiment of FIGS. 5 and 6, the magnet 60 includes a deepened groove 62 in which the magnet assembly 64 seats. The magnet assembly 64 includes a base member 68 sized to seat fully within the groove. The base member has a height h that is generally greater than its thickness t1. The thickness t1 is approximately equal to the thickness of a magnetic strip 70 mounted on the base member 68. The magnetic strip 70 can be similar in size and performance to the magnetic strip 30 described in the preceding embodiment.

The base member 68 includes a series of ramps 72 formed into the bottom surface 74 of the base member 68. The ramps 72 are located so that they ride upon a set of cross pins 75 that are inserted through the magnet, across the groove 62. The cross pins 75 are typically located at a spacing above the floor 78 of the groove 62. The depth d1 is chosen so that the bottom surface 74 of the base member does not come into interfering engagement with the floor 78 of the groove 62 as the ramps 72 ride upon the pins 75. In other words, the base member 68 is free to move upwardly and downwardly (double arrow 80) along a full range of movement enabled by the ramps 72. The upward and downward movement (double arrow 80) enables the magnetic strip 70 to be brought toward, and moved away from, the inner surface of the developer roll 84. As such, the focus and strength of the magnetic field provided by the magnetic strip 70 can be varied. Adjustment of the height of the magnetic strip 70 is accomplished by rotating a threaded nut 88 (see curved arrow 90) to move a screw 92 toward and away from the cartridge housing 94 (see double arrow 96) as the screw is moved toward and away from the cartridge housing 94, a linkage 98 acts upon the base member 68 causing the ramps to ride upwardly and downwardly upon the pins 75. A spring 100 is provided at the opposing end 102 of the base member 68 to maintain tension on the base member so that it remains in contact with the pin 75. The spring 100 can be angled downwardly so that it produces a slight downforce to maintain the ramps 72 firmly against the pins 75. According to this embodiment, fine adjustment of the position of the magnetic strip 70 relative to the developer roll 84 can be made. By also providing a rotational adjustment for the magnet as taught in the above-described patent, the location of the magnetic field can be very accurately positioned for optimum toner release.

Adjustment of the magnet assembly 64 according to this embodiment can be accomplished by using a Gaussmeter positioned at an appropriate location relative to the developer roll. Likewise, known adjustment values can be "dialed into" the threaded nut or adjustment nut 88 during cartridge assembly to obtain a predetermined final position for the magnetic strip 70.

While the adjustment mechanism is manually operated and typically set only during manufacture, a dynamic adjustment mechanism is also contemplated. According to an alternate embodiment (not shown) an electromagnetic or electromechanical actuator can be incorporated into the adjustment mechanism (a powered drive screw for example). The actuator is operated to move the magnet assembly relative to the developer roll during operation of the cartridge. The amount of movement and direction of movement can be dictated by the print perimeters (e.g. lighter or darker) or by the thickness/density of the printing surface. Appropriate measuring devices, such as densitometers can be interconnected with the actuators's control logic to regulate the movement of the magnet assembly.

Figure 7:
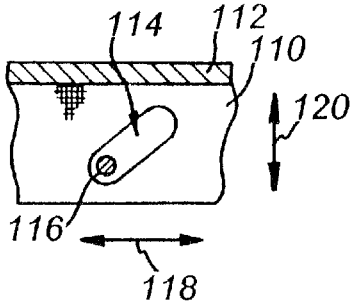
FIG. 7 is a partial side view of another alternate embodiment of an adjustable magnet assembly according to this invention.

FIG. 7 describes an alternate embodiment in which a base member 110 similar to that shown and described in FIGS. 5 and 6 supports a magnetic strip 112. The base member includes slots 114 that are angled and that fully enclose pins 116. A series of angled slots can be provided at spaced intervals along the length of the base member. Only a partial portion of the base member is shown by way of example. In this embodiment, a spring 100 can be omitted since the slots 114 fully capture the pin 116. So long as an adjustment screw firmly holds the base member 110 relative to the cartridge housing (not shown) then movement of the base member 110 is limited. As described above, adjustment occurs by moving an adjustment screw or other fitting (not shown) to cause the base member 110 to move side to side (double arrow 118) side-to-side moving causes the base member to move upwardly and downwardly (double arrow 120) as the slot 114 rides upon the pin 116. While a spring can be omitted in this embodiment, a spring can also be included at a free end of the base member 110 for added security. A fully enclosed slot 114 generally requires that the base member be installed in its slot in the magnet before the pins are driven into the assembly. Pins 116 are generally driven through a respective slot 114 after the base member 110 is accurately located in the slot. The pins 116 then serve to retain the base member 110. The base member can be constructed from a variety of materials in each of the above-described embodiments including metallic materials and plastic materials. If ferromagnetic materials are used for the base member, then the magnetic attraction of the underlying magnet could serve to maintain the base member in the slot against the pins.

One consideration in enhancing or modifying the localized magnetic field of a developer roll magnet adjacent the nip with the image drum is the possibility of edge effects in the magnetic field. In other words, near the ends of a developer magnet, the fields are less uniform, and may turn back on themselves creating undesirable paths of toner travel at the edges of the printout. It is therefore desirable, in some applications to reduce, or alter the effects of the supplementary magnetic strip of this invention acting near the edges of the developer roll magnet.

Figure 8:
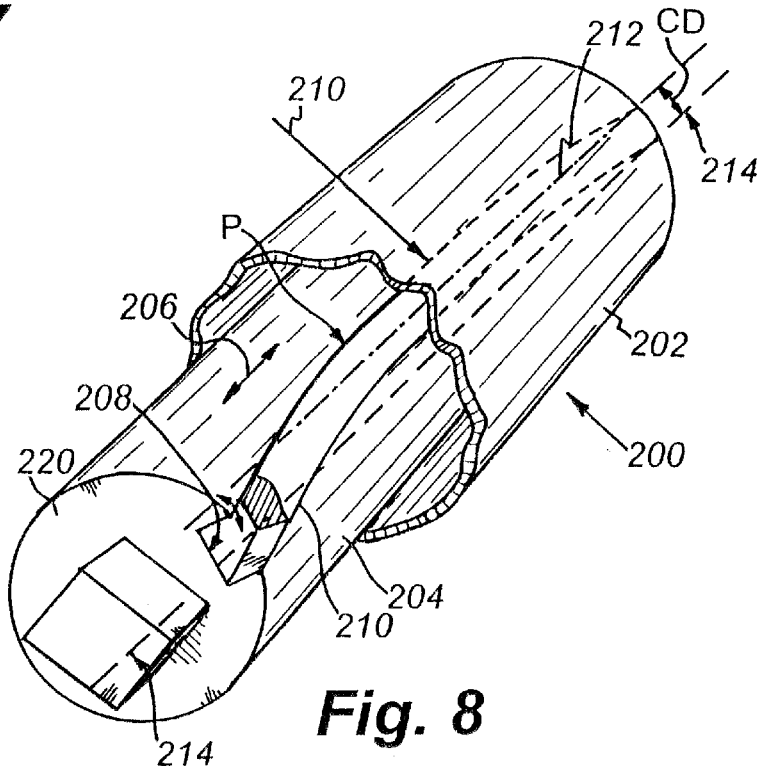
FIG. 8 is a partially exposed perspective view of another alternate embodiment of a developer roll magnet having a radially varied magnetic strip.

In accordance with such an embodiment, FIG. 8 shows a developer roll assembly 200 including an outer sleeve 202 that rotates in a conventional manner, and an inner, coaxial developer roll magnet 204 having a cylindrical shape. The magnet and sleeve are similar to those already described and the magnet is fixed within the sleeve without any rotational or axial (double arrow 206) movement.

The magnet 204 includes a groove 208 having a depth and a width as defined generally above. The groove 208 seats a flexible magnetic strip formed from materials, and having a shape and characteristics as also defined above. Unlike preceeding embodiments, the groove 208 is not linear along the axial direction. Rather the groove 208 is curved about the circumference of the magnet along certain portions of the magnet's overall axial length. As shown, the groove varies radially from a center point (arrow 210) along the axial direction. It is located at a first circumferential location 212 at the center point 210. It is offset to a second circumferential location 214 at the ends of the magnet in this embodiment. The amount of circumferential offset CD can be approximately 10–15 degrees in one embodiment. The strip groove can be linear across most of the magnet 204, and curve into a circumferential offset within approximately 1–2 inches of each end, more or less. The exact circumferential profile of the groove is highly variable. It is set for a given toner cartridge based upon trial and error, using different shaped grooves in operation until improved print performance is observed. In this example the circumferential offset of the groove begins at a point P that is between the center point 210 and the magnet end 220. The radial height of the groove and the circumferential location 212 of the center point 210 can be adjusted relative to the nip as described above to optimize toner release. The circumferential offset is made in addition to these basic optimization steps. However, it is expressly contemplated that, in some embodiments, the location 212 is selected in combination with the offset by trial and error to derive an overall optimal release effect. The circumferential direction of the circumferential offset can be in either circumferential direction. In other words the ends of the strip can lead the release nip or lag the release nip (relative to drum motion). This is, in part, determined by the performance acheived when both orientations are experimented with. In general, either a leading or lagging position will reduce the localized effect of the magnetic strip near the nip at the respective magnet ends.

Figure 9:
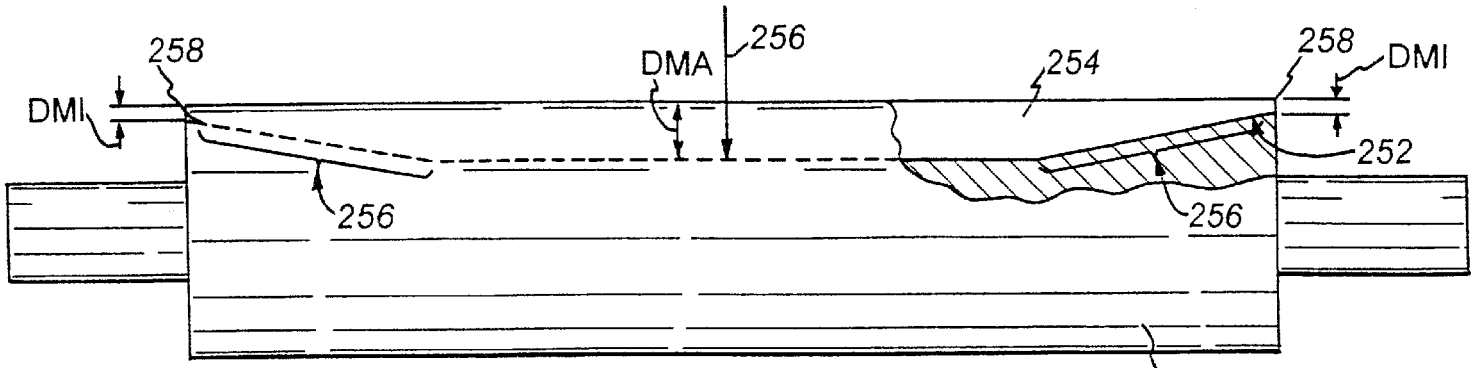
FIG. 9 is another alternate embodiment of a developer roll magnet having a radially ramped magnetic strip.

Another embodiment of a developer assembly with a magnet designed to address edge effect is detailed in FIG. 9. In particular, the developer roll magnet 250 is shown with a linear groove 252. Within the groove is seated a magnetic strip 254. The strip has a maximum radial depth DMA near the magnet's axial center point 256, and a minimum radial depth DMI near the magnet's ends 258. In one embodiment, the minimum depth DMI can be approximately 0.030 inch and the maximum thickness DMA can be approximately 0.090 inch. By varying the thickness of the magnetic strip 254, the strength of the magnet near its ends 258 is reduced. A linear ramping (260) can occur on the magnetic strip 254 between the minimum and maximum depths. The ramp can be curved in an alternate embodiment. The ramp distance can, again be determined by trial and error as well as the difference between maximum and minimum thicknesses. In this embodiment the ramp begins approximately 1–2 inches from each end 258 of the magnet. Typically, the underlying linear groove 252 in this embodiment is cut to conform to the shape of the ramp. The magnetic strip 254 can float freely in the groove, and project above the surface of the magnet 250, or the strip can be secured into the groove by any suitable adhesive and, in one embodiment, milled to match the surface contour of the surrounding magnet 250. The circumferential location of the magnetic strip, and its radial height can be adjusted with respect to the nip as described above based upon the desired toner release charactistics.

Figure 10:
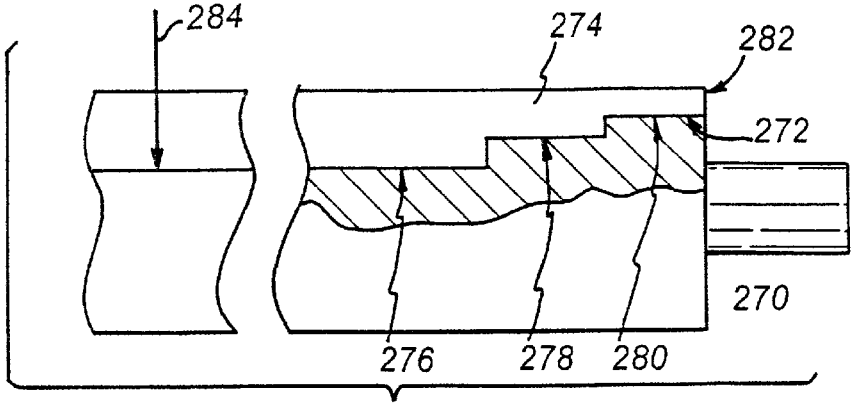
FIG. 10 is another alternate embodiment of a developer roll magnet having a radially stepped magnetic strip.

Note that FIG. 10 details an alternate embodiment in which the developer roll magnet 270 includes a groove 272 that seats a magnetic strip 274 having different thickness steps 276, 278 and 280, that thin from the center toward the end. This arrangement may be desirable for providing a reduced magnet strength taken from the magnet's center point 284 to the magnet's ends 282 with a less-complex ramp formation process. All other aspects of this embodiment are the same as those with respect to FIG. 9.

The foregoing has been a detailed description of preferred embodiments of the invention. Various modifications and additions can be made without departing from the spirit and scope of the invention. For example, the magnetic strip defines a rectangular cross-section. It is contemplated that a semi-circular, round or other cross-section shape can be used. In addition, although the magnetic strip is located adjacent the nip in this description, it is contemplated that magnetic strips can be located at other portions of the circumference of the magnet such as the pick-up point adjacent the toner tank, adjacent the South poles of the magnet or at points located circumferentially between the North and South poles. Likewise, a plurality of magnetic strips can be used to enhance the magnetic field at different points about the circumference of the magnet. Magnetic strips can be positioned at diametrically opposed positions about the magnet's circumference to generate a "balance" of forces that can be desirable in certain embodiments. Finally, while one form of adjustment mechanism is shown, a variety of mechanisms that move the magnetic strip toward and away from the underlying magnet to change its position relative to the developer roll are contemplated. These mechanisms generally involve the use of a magnetic strip having a base or other stiffening member and a mechanism for driving the magnetic strip away from the underlying magnet and toward the developer roll inside surface. Finally, it is expressly contemplated that the magnetic strip can be variable in thickness across its length and also in terms of circumferential offset across the length of the developer roll magnet simultaneously. Accordingly, this description is meant to be taken only by way of example and not to otherwise limit the scope of the invention.

What is claimed is:

1. An improved developer roll for a toner cartridge comprising:

a developer roll sleeve rotatably mounted within a housing of the cartridge adjacent a toner tank and an image transfer drum;

a substantially stationary developer roll magnet located within the developer roll sleeve, the magnet being substantially cylindrical and being substantially coaxial with the developer roll sleeve; and a strip of magnetic material extending axially along a surface of the magnet at a predetermined position about a circumference of the magnet, the strip defining an increased magnetic field at the predetermined position along the developer roll magnet surface, wherein the strip is mounted in a groove extending axially on the developer roll magnet surface with a base of the strip positioned adjacent to a base of the groove, the base of the groove having a depth in a radial direction that is variable with respect to the developer roll magnet surface taken along an axial direction so that a magnetic field generated by the strip is variable axially along the surface of the developer roll.

2. The improved developer roll as set forth in claim 1 wherein the strip of magnetic material is located adjacent a a circumferential location on the image transfer drum to which toner is released by the developer roll sleeve formed between the developer roll sleeve and the image transfer drum.

3. The improved developer roll as set forth in claim 1 wherein the strip comprises a flexible magnetic material.

4. An improved developer roll for a toner cartridge comprising:

a developer roll sleeve rotatably mounted within a housing of the cartridge adjacent a toner tank and an image transfer drum;

a substantially stationary developer roll magnet located within the developer roll sleeve, the magnet being substantially cylindrical and being substantially coaxial with the developer roll sleeve;

a strip of magnetic material extending axially along a surface of the magnet at a predetermined position about a circumference of the magnet, the strip defining an increased magnetic field at the predetermined position along the developer roll magnet surface and wherein the developer roll magnet includes a groove for receiving the strip extending axially along the surface of the developer roll magnet; and wherein the strip of magnetic material is located at a circumferential offset on the developer roll magnet with respect to an axial position to locate opposing axial ends of the strip of magnetic material further from a circumferential location on the image transfer drum to which toner is released by the developer roll sleeve than an axial central portion of the strip of magnetic material.

5. The improved developer roll as set forth in claim 4 wherein the strip comprises a flexible magnetic material.

6. An improved developer roll for a toner cartridge comprising:

a developer roll sleeve rotatably mounted within a housing of the cartridge adjacent a toner tank and an image transfer drum;

a substantially stationary developer roll magnet located within the developer roll sleeve, the magnet being substantially cylindrical and being substantially coaxial with the developer roll sleeve;

a strip of magnetic material extending axially along a surface of the magnet at a predetermined position about a circumference of the magnet, the strip defining an increased magnetic field at the predetermined position along the developer roll magnet surface; and wherein the strip of magnetic material varies in radial thickness along the axial direction so that a reduced thickness is located adjacent each of opposing axial ends of the developer roll magnet with respect to a central axial location.

7. The improved developer roll as set forth in claim 6 wherein the strip comprises a flexible magnetic material.

8. An improved developer roll for a toner cartridge comprising:

a developer roll sleeve rotatably mounted within a housing of the cartridge adjacent a toner tank and an image transfer drum;

a substantially stationary developer roll magnet located within the developer roll sleeve, the magnet being substantially cylindrical and being substantially coaxial with the developer roll sleeve;

a strip of magnetic material extending axially along a surface of the magnet at a predetermined position about a circumference of the magnet, the strip defining an increased magnetic field at the predetermined position along the developer roll magnet surface; and wherein the strip of magnetic material is fixed on the magnet by mutual magnetic attraction between the strip of magnetic material and the magnet.

9. An improved developer roll for a toner cartridge comprising:

a developer roll sleeve rotatably mounted within a housing of the cartridge adjacent a toner tank and an image transfer drum;

a substantially stationary developer roll magnet located within the developer roll sleeve, the magnet being substantially cylindrical and being substantially coaxial with the developer roll sleeve;

a strip of magnetic material extending axially along a surface of the magnet at a predetermined position about a circumference of the magnet, the strip defining an increased magnetic field at the predetermined position along the developer roll magnet surface; and a base member for mounting the strip of magnetic material wherein the base member is movably mounted relative to the magnet so that the base member and the strip of magnetic material are movable toward and away from the developer roll sleeve.

10. The improved developer roll as set forth in claim 9 further comprising a groove on the surface of the magnet for receiving the base member.

11. The improved developer roll as set forth in claim 10 wherein the base member and the groove include interengaging formations constructed and arranged so that axial movement of the base member along the groove causes radial movement of the base member toward and away from the developer roll sleeve.

12. The improved developer roll as set forth in claim 11 wherein the base member includes ramps and wherein the groove includes cross pins that ride upon the ramps and wherein the base member includes an adjustment screw that engages a wall of the toner cartridge and wherein the screw is adjustable relative to the wall to move the base member in an axial direction.

13. A method for improving a developer magnet coaxially mounted within a developer roll sleeve of a toner cartridge, comprising the steps of:

defining a groove having a base in the magnet that extends axially across a predetermined length of the magnet on a surface thereof, including forming the base with a depth in a radial direction that is variable with respect to the developer magnet surface taken along an axial direction;

locating a strip of magnetic material within the groove, the strip of magnetic material providing an enhanced magnetic field in a predetermined location; and mounting the strip in the groove so a base of the strip is positioned adjacent to a base of the groove, the base of the groove having so that a magnetic field generated by the strip is variable axially along the surface of the developer roll sleeve.

14. The method as set forth in claim 13 further comprising the step of rotationally orientating the magnet so that the strip of magnetic material is adjacent a circumferential location on an image transfer drum to which toner is released by the developer roll sleeve.

15. A method for improving a developer magnet coaxially mounted within a developer roll sleeve of a toner cartridge, comprising the steps of:

defining a groove in the magnet that extends axially across a predetermined length of the magnet on a surface thereof;

locating a strip of magnetic material within the groove, the strip of magnetic material providing an enhanced magnetic field in a predetermined location; and varying a radial location of the strip of magnetic material relative to the magnet to selectively position the strip at predetermined distances relative to the developer roll sleeve to change a strength and field characteristic of the strip at a circumferential location on an image transfer drum to which toner is released by the developer roll sleeve.

16. A method for improving a developer magnet coaxially mounted within a developer roll sleeve of a toner cartridge, comprising the steps of:

defining a groove in the magnet that extends axially across a predetermined length of the magnet on a surface thereof;

locating a strip of magnetic material within the groove, the strip of magnetic material providing an enhanced magnetic field in a predetermined location; and moving a movable base member that seats within the groove radially toward and away from the developer roll sleeve.

17. A method for improving a developer magnet coaxially mounted within a developer roll sleeve of a toner cartridge, comprising the steps of:

defining a groove in the magnet that extends axially across a predetermined length of the magnet on a surface thereof;

locating a strip of magnetic material within the groove, the strip of magnetic material providing an enhanced magnetic field in a predetermined location; and locating the strip of magnetic material in the groove so that the strip varies circumferentially with respect to an axial line along the surface of the magnet.

18. A method for improving a developer magnet coaxially mounted within a developer roll sleeve of a toner cartridge, comprising the steps of:

defining a groove in the magnet that extends axially across a predetermined length of the magnet on a surface thereof;

locating a strip of magnetic material within the groove, the strip of magnetic material providing an enhanced magnetic field in a predetermined location; and defining the strip of magnetic material with a radial thickness that varies with respect to axial length along the developer magnet.

19. A method for improving a developer magnet coaxially mounted within a developer roll sleeve of a toner cartridge, comprising the steps of:

defining a groove in the magnet that extends axially across a predetermined length of the magnet on a surface thereof;

locating a strip of magnetic material within the groove, the strip of magnetic material providing an enhanced magnetic field in a predetermined location; and wherein the step of defining the groove includes providing a greater thickness remote from opposing axial ends of the developer magnet and a lesser relative thickness adjacent to each of the opposing developer roll sleeve ends.

20. A method for improving a developer magnet coaxially mounted within a developer roll sleeve of a toner cartridge, comprising the steps of:

defining a groove in the magnet that extends axially across a predetermined length of the magnet on a surface thereof;

locating a strip of magnetic material within the groove, the strip of magnetic material providing an enhanced magnetic field in a predetermined location; and reducing a magnetic strength of the magnetic strip adjacent to each of opposing axial ends of the developer roll sleeve.

* * * * *